US005673039A

United States Patent [19]

Pietzsch et al.

[11] Patent Number: 5,673,039

[45] Date of Patent: Sep. 30, 1997

[54] METHOD OF MONITORING VEHICULAR TRAFFIC AND OF PROVIDING INFORMATION TO DRIVERS AND SYSTEM FOR CARRING OUT THE METHOD

[75] Inventors: Heinz Werner Pietzsch, Karlsruhe; Rigobert Opitz, Waldbronn; Rolf Edelmann, Durmersheim; Jürgen Jaki, Linkenheim-Hochstetten, all of Germany

[73] Assignee: Pietzsch AG, Ettlingen, Germany

[21] Appl. No.: 524,048

[22] Filed: Sep. 6, 1995

Related U.S. Application Data

[63] Continuation-in-part of Ser. No. 45,590, Apr. 9, 1993, abandoned.

[30] Foreign Application Priority Data

| | | | |
|---|---|---|---|
| Apr. 13, 1992 | [DE] | Germany | 42 12 341.0 |
| Dec. 24, 1992 | [DE] | Germany | 42 44 169.2 |
| Dec. 29, 1992 | [DE] | Germany | 42 44 393.8 |

[51] Int. Cl.[6] ..... G08G 1/09

[52] U.S. Cl. ..... 340/905; 340/932; 340/933; 340/934; 340/332; 364/437

[58] Field of Search ..... 340/901–905, 340/932, 934, 920, 331, 332, 910, 911, 471, 488, 933; 364/436–438

[56] References Cited

U.S. PATENT DOCUMENTS

| | | | |
|---|---|---|---|
| 3,529,284 | 9/1970 | Villemain | 340/932 |
| 3,872,423 | 3/1975 | Yeakley | 340/932 |
| 4,264,890 | 4/1981 | Markl | 340/310 |
| 4,350,970 | 9/1982 | Von Tomkewitsch | 340/905 |

*Primary Examiner*—Donnie L. Crosland
*Attorney, Agent, or Firm*—Max Fogiel

[57] ABSTRACT

An arrangement for monitoring vehicular traffic and providing information and warnings to drivers of traffic disruptions, driver error, dangerous road conditions, and severe weather. Road and traffic conditions are detected with roadside traffic sensing equipment, and the conditions are displayed over luminescent elements with signal lamps distributed at intervals along the road and combined into chains of lamps. The luminescent elements are illuminated simultaneously or in sequence for providing continuous traffic information. A processor network and a signal network are combined through a communication network to regulate the luminescent elements by processing, if necessary, under real time controlled conditions.

33 Claims, 10 Drawing Sheets

METHOD OF MONITORING VEHICULAR TRAFFIC AND OF PROVIDING INFORMATION TO DRIVERS AND SYSTEM FOR CARRING OUT THE METHOD

BACKGROUND OF THE INVENTION

The present application is a Continuation-In-Part of the parent application Ser. No. 045,590, filed Apr. 9, 1993 now abandoned.

The present invention concerns first a method of monitoring vehicular traffic and of providing information and warnings in due time to drivers of traffic disruptions, driver error, dangerous road conditions, and severe weather. The invention also concerns a system for carrying out the method.

Sampling stretches of road with sensors to statistically determine traffic situations, and correlating and processing the results at a traffic-control center is known. The method makes it possible to vary traffic-control signs on the basis of the processing results and accordingly help drivers decide what driving tactics to employ, with respect to speed for instance.

Economics unfortunately dictate that variable-message traffic signs are found only sporadically at neuralgic [sic!—translator] traffic nodes. It is also and particularly unfortunate that the interval between detecting a particular traffic situation and the associated effect on the traffic is too long, given how rapidly changes occur, to make it possible to warn drivers of critical situations and to decrease the risk of further accidents consequent to an original accident.

Also known is a system of monitoring traffic and providing information that uses radio beacons with lamps distributed at intervals along a road. The beacons can be connected to and disconnected from a control center and are activated by integrated receiving equipment. The signal-lamp receiving equipment communicates with transmitters in motor vehicles. The transmitters themselves are controlled by speedometers and crash sensors in the vehicles and themselves activate the lamps in the beacons.

The theory behind this traffic-monitoring and information-providing system is that a system of chains of lamps communicates by way of appropriate receiving and transmitting equipment with sensors installed in vehicles. The lamps are accordingly enabled to emit warning signals appropriate to the vehicle's operating state of the vehicle and even when individual vehicles or groups of vehicles are stopped, when traffic situations so dictate. The operating state of a vehicle in traffic can of course only be detected and exploited to activate the beacon system when the vehicle is equipped with the appropriate sensors and with transmitting equipment activated by them. The operating states of all the other motor vehicles participating in the traffic cannot on the other hand be detected and exploited to provide information and warning signals.

Another traffic-control system, known from an U.S. Pat. No. 3,529,284 uses signal lights, too. A row of lights of three different colors is positioned between individual traffic intersections to regulate the speeds of individual vehicles. The speed of each vehicle is regulated to maintain each within a wave of green lights from intersection to intersection. The various colors accordingly have a specific effect on traffic control.

The vehicles are for this purpose detected by a strip of sensors extending across the road. The results are forwarded to a central processor that accordingly controls the signal lights along the associated section of road. The central processor can also be provided with additional information as to weather, for example, or parking-place availability, and this information can also be displayed along the road.

The drawback of this system is the exclusively central processing of the signal lights by way of an expensive and complicated network. Real Online surveillance subject to real-time conditions is impossible because of the unavoidably long and varying signal periods. The controls-technology expenditure is considerable due to the use of three colors for each light. In addition to expensive cabling, the roads must also be expensively refitted with an entirely new type of signal technology in this system.

SUMMARY OF THE INVENTION

One object of the present invention accordingly is an improved method of the genus and purpose initially described that will allow dynamic monitoring of the total traffic in a stretch of road equipped with such a monitoring and information-provision system as well as due information and warnings to drivers and hence the possibility of regulating the traffic, but that does not require that the vehicles be equipped with appropriate sensors and transmitting equipment. Another object is a traffic monitoring and information-providing system that will carry out such a method.

The combination of measurement network, a processor network, and signal network constitutes a method, working with a distributed-intelligence system, whereby traffic control and regulation are completely decentralized and conducted on site along the road. The luminescent elements themselves can be manually programmed directly on site by way of decentralized processors as well as remotely to load flashing programs for example. The road and traffic conditions, detected by a sensing equipment or manually entered are displayed over luminiscent elements with signal lamps distributed at intervals along the road, combined into chains of lamps, and illuminated simullaneously or in sequence, providing continuous traffic information and when necessary warning in real time. The system is especially used for dangerous road sections to improve traffic safely and to realize a smooth traffic flow.

Specifically, processors are positioned directly along the road within the processor network, e.g. a road-event-processor directly connected to the signal lights controls in response to signals obtained from detection points. The individual road-event processors are, connected together by a processor network in the form of an intelligent bus system. An inconvenient and complicated cabling is entirely lacking.

Section by section, one of the processors in each section is a master processor that packages the data it encounters and organizes the processors in relation to one another The master processor also communicates by way of up-to-date means with a central control room. The network architecture has distributed but still connected function. Superordinate algorithms such as statistical evaluations or large-area controls can be executed from the control room. Overall alarm signals or other types of intervention can in particular also be dealt with by releasing appropriate commands to the luminescent elements. Such events would occur in relation to accidents, traffic jams, and bad weather for example. Such a distribution of traffic-control functions into rationally centralized and decentralized algorithms enables a new quality of traffic control.

The invention accordingly concerns providing, in accordance with traffic situations and/or disruptions detected by the traffic-and-load sensing equipment or manually entered, drivers with information about such situations and/or disruptions by means of signal lamps distributed at intervals along the road, information that will affect the drivers' behavior. Chains of lamps out of interconnected luminescent elements can be operated continuously with a prescribed length as road-layout accessories. This can be done with flashes of light traveling in both directions, forward and backward, along the particular chain of lamps, whereby pulse length, frequency, and engagement action can be varied.

Another advantage of the system in accordance with the present invention is its employment of only one color for the signal lights. Traffic is controlled only by varying the parameter intensity, frequency, and direction of the particular signal light. In contrast to the exclusively command function of said signal lights accordingly to the mentioned U.S. patent, what occurs here is a generally comprehensible and attention-atrracting warning function. Lights that flash at an optional rate, animated signals that travel in an optional direction and at an optional speed, and waves of flashing lights are in particular possible. This represents definitely decreased operation expense as compared to the U.S. patent in that only one color per light needs to be turned on. Wiring expense is accordingly reduced ⅔ as compared with the known system. Another decisive advantage is that conventional guideposts can be provided with the luminescent elements. The cost of carrying out the method in accordance with the present invention is accordingly even lower compared to the method of the U.S. patent.

Another basic difference between the invention and the known system is the that the U.S. patent describes only a strict intersection control whereby the traffic is subject to surveillance and control only in relation to the next intersection. Real-time surveillance by forwarding data associated with a single vehicle from one section to another by way of meshed networks as in the present invention is impossible in the known system. This will also be evident in that in the known system, the control section extends statically from one intersection to the next. Variable control-section length of the type unavoidable for dynamic traffic control is possible only with the method in accordance with the present invention. Surveillance for accidents and dangerous driving are additionally possibilities of the invention. In the method in accordance with the present invention this is possible in that the entry of every vehicle as well as of what within a section road under surveillance, whereby the time that usually elapses until the next detection point is reached can be individually evaluated or predicted for each vehicle. If an expected vehicle is absent throughout a specific interval or if other thresholds are exceeded, a graduated alarm is triggered and transmitted to the superordinate surveillance device. Oncoming vehicles, for example, can then be alerted about a jam as they encounter flashing lights. Analysis of the reason for the warning will then occur interactively and in accordance with centralized and decentralized algorithms. The luminescent elements can then be controlled in accordance with the revealed cause.

It will be evident from the foregoing that, although what the U.S. patent describes is indeed a traffic-control system with signal lights, but the present invention concerns a new traffic-control-concept of distributed intelligence by a special network architecture with data busses.

One embodiment of the invention provides means of dealing with violations when they are detected. Excess speed, truck passing, overload, driving in the wrong direction, etc. are examples. In such events the lamp-element signal lamps will blink and inform the drivers of what violations are detected. It is practical for the chains of lamps to operate in real time in conjunction with the traffic-and-load sensing equipment, using various malfunction-detection algorithms. The blink modes of individual signal lamps forward of a vehicle can also be visible at the same rate of travel and the same stretch of road. It will be of advantage for this to continue until the detected violation ceases. A drive will accordingly not only be constantly educated as to his misbehavior but will also be forced to resume driving properly.

Another embodiment of the method in accordance with the invention addresses warnings displayed for a specific effect and especially important information. The threshold of visual perceptibility of the signal lamps and their various levels of brightness above that threshold in comparison with that of continuous illumination can be increased or optimized by ergonomically optimizing the pulse frequency. The result is intensified subjective conspicuousness. The luminescent elements can also be operated at different intensities in accordance with the time of day (daylight or darkness) and season (summer or winter).

Another important embodiment of the method effectively regulates traffic. The signal lamps in the luminescent elements interconnected to create chains of lamps in this embodiment can be operated with flashes of light traveling at ideal speed along the chain in the direction of traffic. Drivers will be intuitively motivated to adapt their driving speeds to the ideal represented by the flashes of light traveling in the direction of traffic. The necessary result is uniformization and pacification of the traffic due to synchronization of the driving speed of all drivers.

Drivers often stop or slow down to rubberneck at accidents in oncoming traffic or at spectacular non-traffic occurrences at the side of the ride. Another embodiment of the method prevents this. The signal lamps in the chains of lamps are operated with flashes of light that travel along with and help to promote the flow of traffic. It can in this event be practical for the flashes of light emitted by the signal lamps in the luminescent elements to differ in hue. The states of illumination of the luminescent elements or chains of lamps can also be monitored and regulated by a control center.

Another important variation of the method provides drivers with information about traffic situations and/or road conditions in the stretch of road ahead. Road sensors connected to processing-and-control sets illuminate and activate several lamp-chain elements backward, against the direction of traffic.

Another embodiment of the invention, finally, ensures real-time behavior and occupies continuous stretches of road. The chains of lamps are either activated by a road sensor element with electronic processing and automatic malfunction recognition or by manual illumination. The result will be a shorter reaction time. Activation consequent on interpretation of traffic date from two or more sensors and processors and comparing them to obtain a mean reaction time will result in a moderate reaction time. Activation by way interpretation of the sensor system by procedures carried out in control centers of course will lead to longer reaction times.

The second object is a system of monitoring traffic and providing information that can be used to carry out the method. This object is attained in the system recited in the preamble to claim 16. A detection point is provided with traffic-and/or-load sensing equipment that operate essentially across the lane of a road. At least two luminescent elements are associated with the detection point. The luminescent elements are distributed at intervals along the road, statically or dynamically interconnected, and provided with optical signal generators in the form of signal lamps and with at least one processing-and-control set in the form of a road-event processor. The processing-and-control sets process detected traffic situations and/or road conditions and illuminate and activate the signal lamps.

At least two and preferably more luminescent elements provided with signal lamps are accordingly associated with each detection point provided with a road-condition sensor and processing-and-control sets. The length of the intervals between the luminescent elements depends on the particular situation.

The system in accordance with the invention differs from that at the state of the art. The luminescent elements installed in the form of chains of lamps along at least one side of the road are not controlled in accordance with the invention by radio from sensors and transmitters inside the vehicles or by a control center. They are controlled by way of roadside sensors by a road-event processor that processes the traffic situations and/or road conditions detected by the sensors. The processor then emits signals in accordance with the traffic situation detected. The flashes can be individual flashes or groups of flashes ahead of the traveling vehicles. They can also be in the form of synchronized waves of light that travel forward or backward at various frequencies, accelerating and decelerating the flow of traffic.

There is accordingly no direct communication in accordance with the invention between the individual vehicles in traffic and the luminescent elements. The vehicles are monitored by roadside sensors. It is accordingly not just motor vehicles equipped with special sensors and transmitters that are monitored, but basically all the vehicles.

The system can, however, also have several detection points distributed at prescribed intervals along the road with traffic-and/or-load sensing equipment, interconnected luminescent elements, and at least one processing-and-control set in the form of a road-event processor, accordingly comprising a monitoring and information-provision system that covers at least some sections of each stretch. The luminescent elements can be distributed along either the right or the left side of the road. Luminescent elements on both sides of the road, however, turn out to be particularly practical. Such luminescent elements can be combined into chains in the form of a bus, can be activated in groups or individually, and can alternate between two signal hues, yellow and red for example.

At least some of the luminescent elements or signal lamps in another important advanced version have a manual emergency switch for illuminating chains of lamps to activate luminescent elements more or less opposite the flow of traffic along an interval that depends on road layout.

It can also be practical in the system in accordance with the invention for the road-event processors that act as processor and control units at several detection points, distributed at intervals of several hundred meters for example depending on local requirements, to communicate through a network.

The traffic-and/or-load sensing equipment can in practical terms comprise speed sensors, axle detectors, induction loops, drive-over scales, wheel-load meters, and similar equipment.

It is also practical in terms of another advanced version of the invention for each detection point to have a processing unit in the form of a road-event processor for detecting and processing specified traffic situations and/or road conditions and controls in the form of a signal processor that operates in conjunction with the traffic processor to activate the lamp modules or luminescent elements.

The roadside sensing system of detection points that detect traffic situations and/or road conditions in another important embodiment of the invention communicates through a network with a road-event processor that in its capacity as overall processor activates the lamp-element signal lamps individually, all together, or in a specified sequence and coordinates interface cards for various sensors or signal-processing units.

The roadside sensing system can consist of induction loops, axle detectors, or weight sensors embedded in the pavement. The weight sensors can be drive-over scales in the form of strain gauges, piezoelectrics, or capacitative strips. Sonar, microwave, and/or infrared sensors not embedded in the pavement for example can also be employed.

A sequence of detection points along a road can within the scope of the present invention also be equipped with a system of sensors for detecting traffic situations and/or road conditions. Each sensor communicates through a network with a road-event processor. The road-event processors themselves are interconnected through a network of processors. Each road-event processor accordingly operates in conjunction with the system of sensors associated with it, and the road-event processors associated with various stretch-of-road sections intercommunicate. A system of this type constitutes a basis for real-time traffic regulation.

The road-event processor in another embodiment of the invention is designed such that the overall empirical cross-section of the lanes in a road and the system of sensors defined for each lane can be flexibly configured. One processor system an accordingly handle several empirical cross-sections and or luminescent elements.

The architecture of the road-event processor in another embodiment is modular and comprises various signal processors and interface inserts along with a master processor that coordinates them. It is practical for the master processor in such a system to be programmed in a high-level language. The signal processors for example can in order to accelerate operations be programmed in assembly language.

The road-event processor in another advanced embodiment has slots for potential expansion or for interchanging sensors and sensor-system interfaces. This road-event processor is also structured to afford such multiple expansion as the further development of traffic count-and-classification equipment into a dynamic weighing system with an empirical load-flow cross-section. For this purpose it requires the insertion of a sensor-interface card and corresponding sensors, drive-over scales for example. Piezoelectric and capacitative-strip sensors can be employed for the same purpose.

The aforesaid road-processor design also allows expansion of the activating system in that the processors can be exploited to activate variable-message traffic signs, traffic-guidance systems, illuminated command signs, and illuminated instruction signs. The system can of course also be designed to exploit signals from traffic-guidance systems appropriately processed in the road-event processors to activate warning systems.

It has been demonstrated particularly effective for all the processors and slots to be replaceable and communicate through a bus in the form of a mother board. The sensor coupling can simultaneously be served by modular connector boards, and it should be possible to attach the appropriate connector board for each type of sensor or interface.

The board should have integrated anti-lightning protection. The standard sensor-system interfaces should be capable of expansion or replacement as needed. The signal cables are then connected to the boards by strip terminals, with each cable strand leading to a sensor board.

The road-event processor in another important embodiment is designed by means of a special interface module to be network-ready for a real-time computer network and for the synchronized operation of parallel networks and hence for the real-time coupling of sensor systems and actuating systems. This approach allows for reasonable real-time traffic-detection sensor-system coupling to the luminescent elements distributed at intervals along at least one side of the road as well as to illuminated command signs, illuminated instruction signs, and variable-message traffic signs.

It is practical for the road-event processor in order to monitor its own function and the sensor system and to diagnose any errors, to have self-testing equipment. This equipment will be designed for simple operation even by inexperienced personnel, construction employees for example, to test how the equipment functions. The self-testing equipment can accordingly be provided with automatic search or can operate by way of menus when connected to a portable computer.

The road-event processor in another important embodiment of the invention has an interface for telecommunications. The telecommunications can be through a telephone connection and modem or through modem operation by directional, satellite, or similar radio transmission.

The road-event processor in another important embodiment has remote diagnostics, and its function can accordingly be remotely monitored. It is practical in another advanced version for the sensor system connected to the road-event processor as well to be remotely diagnosed. Such remote diagnosis can identify malfunctions of the induction loop, as can the main-processor unit and/or sensor module during self testing. Any communications or environmental-detection units can also self test for functional capacity by means of remote diagnosis.

The processors equipped with telecommunications in another advanced version are designed to allow the input and verification of parameters and thresholds. Access is simply by code and can be secured with a password.

The road-event processor in another important embodiment is designed with malfunction-detection algorithms to identify various hierarchies of traffic malfunction. The hierarchies can be the empirical cross-section with threshold criteria, speed limits for example or acceleration, as well as stretch-of-road sections between adjacent empirical cross-sections. It is, however, also possible to compare the empirical cross-section of a stretch-of-road with the empirical cross-section of the previous or subsequent stretch-of-road section. A stretch of road can also be considered through several empirical cross-sections by different types of detection and time-constant and practical methods and algorithms.

The road-event processor in another important embodiment is designed for processing data detected with respect to individual vehicles or groups of vehicles, emitting specific parameters and comparing them with variable thresholds. Examples are a speed-limit matrix for individual vehicles and for a series of n vehicles, an acceleration matrix, a minimal bumper-to-bumper distance for individual and for n vehicles, changes in the bumper-to-bumper distance, and axle-load or total-load threshold matrix, and change in the load matrix.

The road-event processor in the aforesaid embodiment can, however, also be provided with a violation matrix of configurable thresholds for comparing individual parameters or combinations of parameters. The particular parameters can be compared individually or in selected combinations with the violation matrix, identified as violations or thresholds infringements, and further processed.

The road-event processor can also be designed within the scope of the invention to classify various traffic malfunctions in the form of migrating jams, accidents, migrating interruptions, narrowing lanes, road-construction bottlenecks, and even driver error. These events can be classified in accordance with type of traffic situation by means of empirical parameters and occurring violations. Classifying the traffic situation assumes sets of rules for simple threshold transgression (single rules) and/or sets of rules for simultaneous threshold transgression, whereby the simultaneity can consist for instance of processing speeds in conjunction with the bumper-to-bumper distance between several vehicles or more.

The road-event processor can also be designed within the scope of the invention for operation with conventional traffic-malfunction algorithms in an individual method or multimodally, with, that is, a combination of various malfunction-identification procedures or in combined algorithms.

The road-event processor can just as well be designed within the scope of the present invention for conventional vehicle identification and for screening signal patterns derived from induction loops and/or axle detector in accordance with dissonance or inter-axle models and/or by analysis of weight.

The features of various vehicle models can be defined in terms of conventional screening in accordance with the particular objective. Up to 50 types can be identified if necessary. It is simultaneously absolutely possible to directly add new classes to an already existing class at the factory as they occur. Such requisite thresholds as wheelbase, vehicle length, and dissonance can be entered into the system directly on site or by telecommunications.

A system of this type can accommodate, display, and forward results from individual vehicles or compress them into specially structured files that can either be stored or further processed. The results obtainable from individual vehicles include count, documentation, bumper-to-bumper distance, classification, weight, axle load, speed, and various events and violations.

The road-condition processor in another important advanced version is designed in neural architecture for processing the detected traffic situations and/or road conditions. Specifically, an error-tolerant associative matrix with a wide range of interception for similar signal patterns that allows real-time processing on site can be employed to code threshold transgression and classify traffic situations. Such an associative matrix accepts as inputs the various traffic parameters and threshold transgressions and maps them onto outputs in the form of traffic-situation classes.

A trained hetero-associative network can also be used in a road-event processor designed in neural architecture for processing detected traffic situations and/or road conditions to classify traffic situations and interruptions in real time. Such a network can be neuronal network that uses images of traffic dimensions and thresholds summarized in a learning file along with practical empirical measurements and/or synthetically generated training patterns and/or signal patterns modified with variances for training purposes. Subsequent to convergence such a network can classify traffic situations and disruptions in real time in an ABLE phase. The procedure occurs directly in the road-event processor and can be embodied as a separate accessory in the form of a plug-in or module.

The road-event processor can also within the scope of the invention be designed in a neural architecture for classifying types of vehicle. Such signal patterns from individual sensors as induction-loop dissonance or even the combined signal patterns from several sensors can be exploited to identify vehicle classes. The process involves neuronal pattern recognition, and the results are subjected to further processing in the scope of disruption identification.

Finally, the traffic-safety system in accordance with the invention can also be characterized by being designed to operate on either external power or battery. The ability to buffer power in a backup battery and preserve stored data and incoming results in the event of an outage has also been demonstrated practical.

Also of proven practicality is a power-consumption optimizing design. Practical tests of an actual system have demonstrated that the current intake for 12-volt direct-current operation is approximately 200 mA. At such low consumption, both battery and solar power are possible.

Still another important embodiment can also be characterized in that every road-event processor is equipped with at least one interface for attaching environmental sensors, for processing and if necessary storing environmental data, and, in the event that prescribed thresholds are transgressed, for emitting alarms or actual-state displays.

Such a traffic-safety system can detect and process environmental data. The road-event processor, again, can provide programmable environmental-detection equipment with detection programs tailored to specific results, can intercept and further process the detected data, and can compress them into files or emit them when necessary in the form of alarms. Alarms can be emitted to an operations center when CO, $CO_2$, NHX, etc. exceed a certain threshold or in conjunction with traffic-control measures. A no-trucks message for example can be displayed on a variable-message traffic sign activated by a road-event processor, as can speed-limit reductions etc. Traffic can accordingly be controlled in real time in accordance with environmental conditions in order to decrease pollution. The invention can accordingly realize a hypermetric interplay between environmental technology and traffic control using an extremely wide range of strategies and thresholds to maintain traffic-induced pollution within bounds.

When the system is, in another embodiment of the invention, characterized by being designed for automatic operation with on-site transgression recognition and automatic alarms, response regulation and traffic-command routing will occur automatically without the intervention of central controls. A stand-alone system of this type is distinguished by complete independence of human management and of the organizational structures of such usually necessary authorities as police, road masters, etc.

When violations on the part of individual vehicles or groups of vehicles are detected with a calculated derivative based on speed, the vehicles can be displayed or warned in real time by appropriate alarms in accordance with the invention.

Vehicle weight or axle load in particular can also be employed within the scope of the invention to detect traffic disruptions along with such other criteria as number of vehicles, model, or speed for the estimation of traffic-engineering parameters and/or disruptions in the form of their predition [sic!—translator]. Transgressions of such stored thresholds as speed, direction, and passing, can also be detected and forwarded for processing.

The luminescent elements in another important embodiment can be provided with signal lamps in the form of light-emitting diodes (LED's), halogen lamps, or incandescent lamps and can individually or in groups constitute luminescent subassemblies. It has also be been demonstrated practical for the luminescent elements to be mounted on a holder secured in the ground. The elements can also be mounted on barriers or integrated into reflecting road-edge marker posts. It is practical for the luminescent-element light-distribution curve to shine mainly toward oncoming traffic and to be adjustable in accordance with road layout.

The luminescent elements in another embodiment, finally, can be programmed individually or reciprocally and controlled manually or by computer in accordance with traffic situations and/or road conditions entered manually or detected by roadside traffic-and/or-load sensing equipment.

Significant in this context is for the luminous flux emitted by the signal lamps to have a high-powered and, for practical purposes, variable radiation characteristic, so that the main beam will always be aimed toward the traffic flowing toward the particular luminescent element and the particular signal will remain longer in the field of view of the driver of the oncoming vehicle. It has been demonstrated particularly practical in accordance with another embodiment for the luminescent elements to emit beams at an angle of approximately 30° and to be aimed at the oncoming traffic such that the road-external flanks of the signal light cone will coincide more or less with the edge of the road along which the luminescent elements are distributed at intervals. Aiming the signal lamps in this way will ensure that the signals remain longer in the drivers' field of view and that the main beam will not undesiredly come to rest perpendicular to the road.

The luminescent elements in the traffic-monitoring and information-providing system in accordance with the invention can be in the form of modules for later installation in existing roadway guideposts. Such a modular luminescent element might be inserted in an adapter in the guidepost. Otherwise, the luminescent elements themselves can be fully contained guideposts.

The signal lamps in another sensible advanced version of the invention are equipped with monochromatic luminous field elements, optionally in such various colors as red and yellow. They can also be in the form of luminous field elements that can be operated on the basis of blended hues without reflectors or covers. The luminous field elements can in particular be constructed in the form of power-optimal LED arrays. They can be provided with invisible brightness regulation by way of pulsed activation at frequencies of more than 50 Hz. The arrays are for this purpose operated over their conventional operating current, which ensures a high yield of light. The total energy consumption of a flat array of approximately 120 LED's for example is in the range of less than 3 watts.

Each LED array in still another advanced version of the invention is encapsulated in a plastic frame to create a luminous field element. They are also mounted on a base to simplify wiring. In accordance with the aforesaid characteristic the LED arrays should have a radiation characteristic of preferably ±15°. The radiation angle on the other hand can easily be extended by tilting the exterior LED frame before encapsulating the diodes.

The LED arrays in another important advanced version are encapsulated at the bottom, allowing them to be used directly outside. Dirt in the bottom of the individual LED's in such an approach will have no effect on brightness because the luminous flux is fixed to the LED dome, which is naturally subjected to self-cleaning action.

It has also been demonstrated practical in accordance with another advanced version to improve contrast by positioning the LED arrays that constitute the luminous field element against dark and preferably black surroundings.

Each luminescent element in another advanced version of the invention can be provided with at least one signal lamp with its main-beam direction toward the oncoming and departing traffic. Warnings can accordingly be issued in both directions as necessary and the flow of traffic regulated.

Another important advanced version is characterized in that the luminescent-element signal lamps are activated by intelligent electronic controls. One practical feature is that the electronic controls have an inherent computer module with a bus interface and are provided with an address that allows programmed activation of a luminescent element.

The intelligent electronic controls can be integrated directly into the luminescent elements or installed separately from the luminescent elements in special in-the-ground housings. It has in this event been demonstrated practical for the signal lamps in the luminescent elements to be routed to their intelligent electronic controls by way of dismantle and/or demolish plugs.

The advantage of removing the electronic controls from the luminescent elements is that the elements will be easier to replace when damaged or during roadside operations like mowing the grass strips. This feature applies to both luminescent elements integrated into guideposts and to those in the form of complete-in-themselves lampposts.

A practical feature within the scope of another advanced version is that the intelligent electronic controls is provided with a self-testing program for testing the activated signal lamps and/or bus interfaces.

The luminescent elements in still another advanced version of the invention are provided with a pushbutton for activating the signal lamps in order to trigger alarm signals through a bus system.

Such buttons can be pushed by anyone. Access can however be restricted to police, staff, and contractors or other authorized personnel by using keyhole switches. Pulse codes can provide equally effective protection against unauthorized use.

The luminescent elements in still another advanced version finally are equipped with means of communication, infrared, microwave, or something similar for example, connected to a system-inherent computer network. The luminescent elements can also within the scope of the invention be equipped with sensors, ultrasonic sensors for example, that communicate with a road-event processor by way of a system-inherent computer network and detect the direction of traffic.

Such an advanced version of the luminescent elements will expand the function to include both luminescent elements and sensor elements. One advantage over conventional detection systems, like induction-loop sensors embedded in the pavement for example, is that traffic can be constantly metered at a distance from the luminescent elements distributed along the side of the road. Another advantage is the elimination of the expense of embedding sensors in the pavement.

The method in accordance with the invention and the system for carrying it out allow effective monitoring of traffic and due provision of information and warnings to following drivers in the event of accidents and mass collisions as well as when visibility is poor, especially because of fog, and during hazardous road conditions, due to ice for example, over long and continuous sections of road and especially and preventively where the traffic is entering sites of disruption. The method and the system developed for it also provide for warning and disciplining drivers in the event of violations detected by attached sensor systems. Such violations include excess speed, overload, disregard of no-passing areas, etc.

The invention takes into consideration that accidents and disruptions of traffic can occur at any place and any time in a section of roadway and that means of ensuring safety and regulating and controlling traffic on site and overall must be introduced and adapted to particular situations. The invention also takes into consideration that traffic-jam feedback can be dynamically displayed by early-warning sensors in the form of specified chains of lamps and can in particular be counteracted at the same rate the jam builds up and before it is encountered. Upstream-traveling traffic-jam warning police vehicles of the type now necessary on superhighways will no longer be necessary. The method and system in accordance with the invention can be employed not only on high-speed routes like superhighways, but also on ramps, meandering stretches, construction sites, and other hazardous areas.

BRIEF DESCRIPTION OF THE DRAWINGS

Three embodiments of the traffic-monitoring and information-providing system in accordance with the invention, one embodiment of the road-event processor, and one of the luminescent element in the form of a lamppost will now be specified with reference to the drawing, wherein.

DESCRIPTION OF THE PREFERRED EMBODIMENTS

Figure 1:
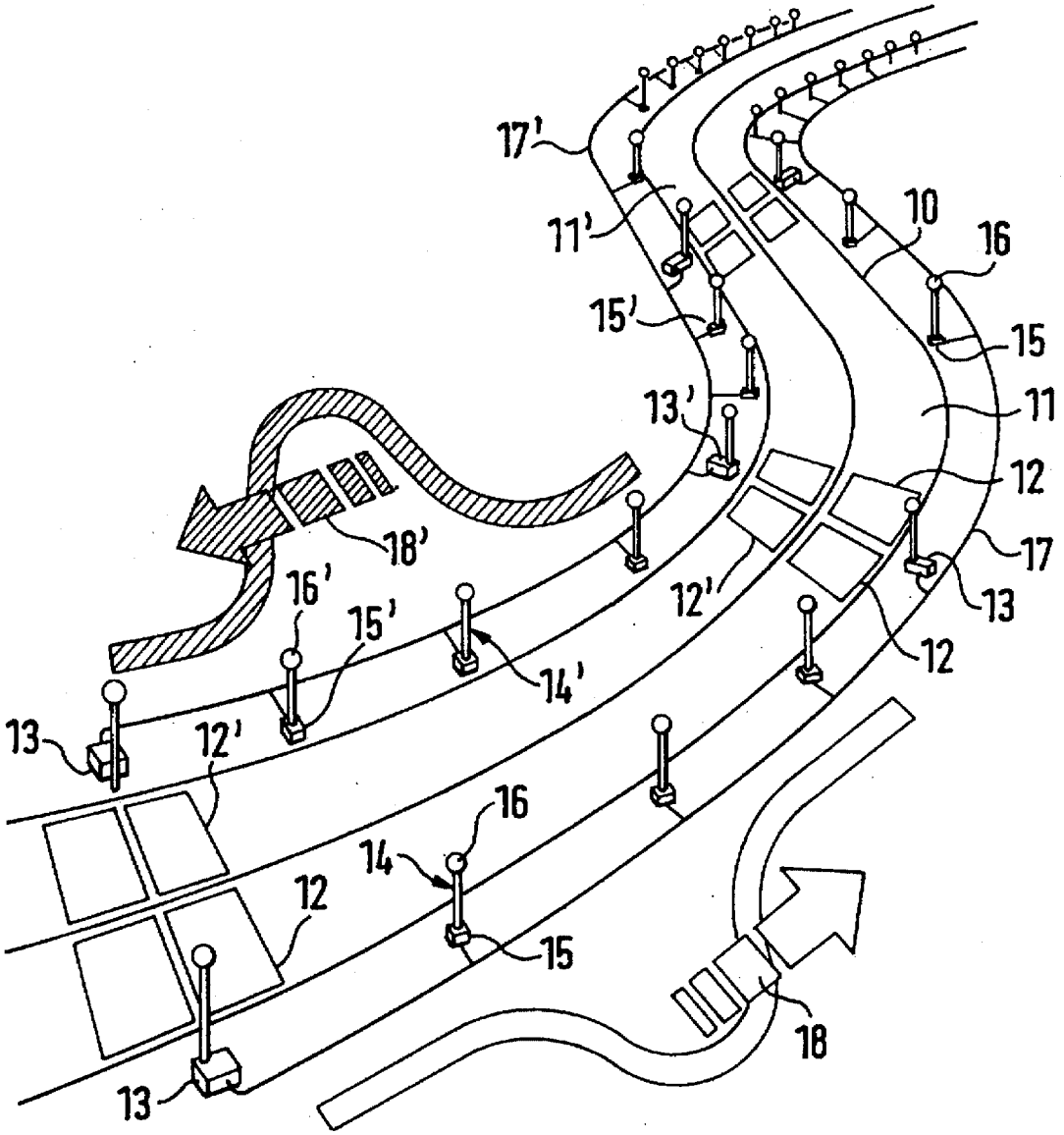
FIG. 1 illustrates a section of a stretch of meandering road equipped with a traffic-monitoring and information-providing system.

The traffic-monitoring and information-providing system invention comprises three subsidiary systems. First, a system of roadside sensors detects traffic situations and/or road conditions. Second, a system of processors processes the detected traffic-situation and/or road-condition data. Third, a warning system includes signal lamps that can be activated by the processors in accordance with the results of the processing.

A road 10 comprises two lanes 11 and 11' that carry traffic traveling in opposite directions. A meandering stretch-of-road section is equipped with a monitoring and information-provision system. Three detection points 12 and 12' are distributed at intervals in the direction of traffic per lane. Each detection point is accompanied by a set of processors and controls in the form of road-event processors 13 and 13'. Distributed at intervals along the road at the edge of the lane are luminescent elements 14 and 14'. The luminescent elements are each provided with electronic controls 15 and 15' and with signal lamps 16 and 16' interconnected in chains and constituting a lighting bus 17 and 17'.

The intervals between detection points 12 and 12' depend on the shape of the road. They are longer when the road is straight and shorter when it is curved. The same relationship exists in relation to the intervals between luminescent elements 14 and 14' and signal lamps 16 and 16'.

The chains of lamps in the system illustrated from above in FIG. 1 extend along the right edge of each lane 11 and 11'. Each chain consists of luminescent elements 14 and 14' interconnected into a lighting bust 17 and 17' and providing information to drivers in its associated lane. The directions of travel are illustrated by arrows 18 and 18'.

Figure 2:
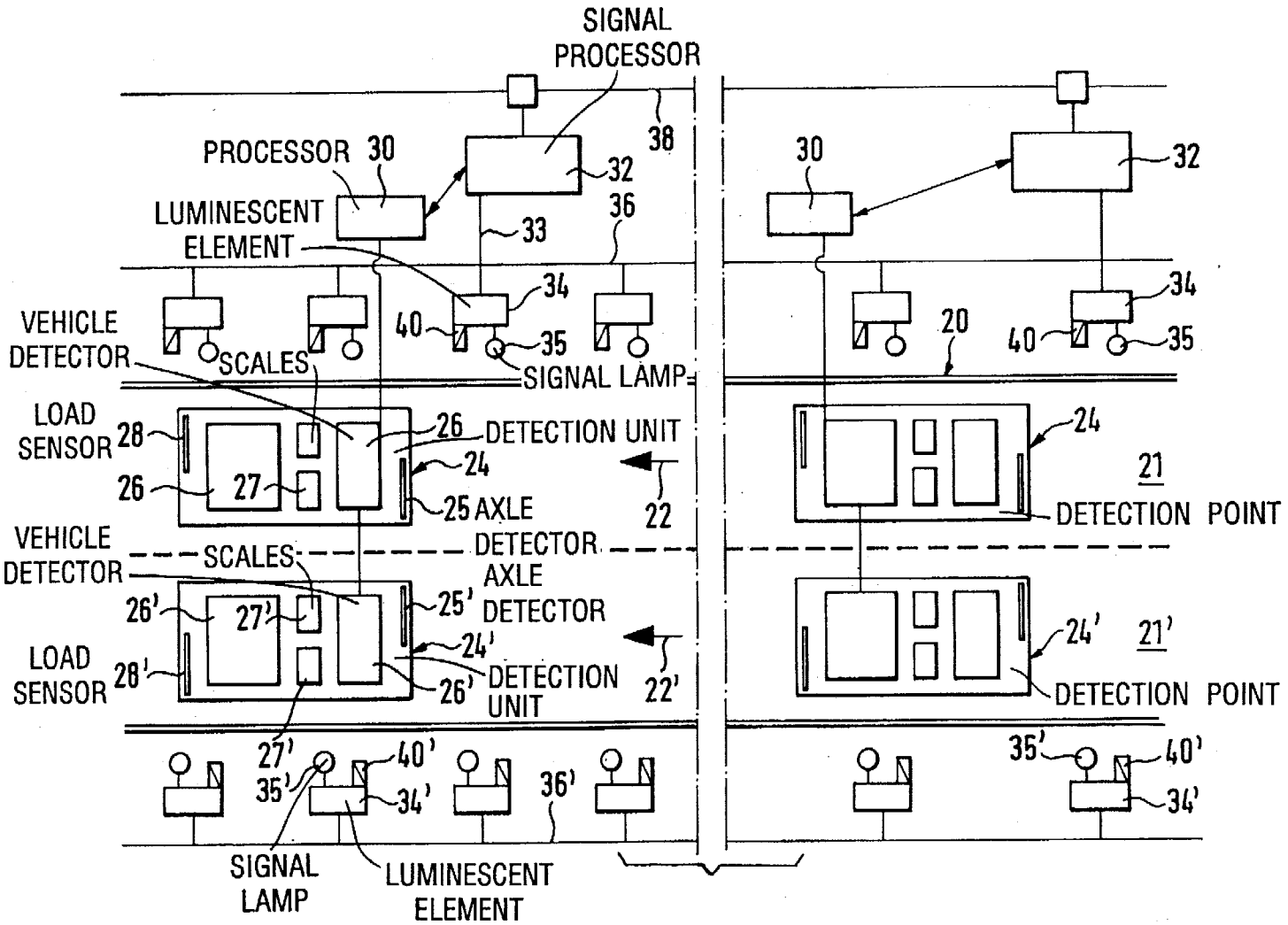
FIG. 2 is a larger-scale view of the system illustrated in FIG. 1, illustrating the individual components.

FIG. 2 illustrates part of a stretch-of-road section 20 equipped with such a monitoring and information-provision system. The section includes two lanes 21 and 21' with traffic traveling in the same direction as indicated by arrow 22 and 22'.

This system has a detection point 24 and 24' in each lane 21 and 21' with traffic-and/or-load sensing equipment imbedded in and extending across the lanes. Detection points of the same design are also, as also illustrated in FIG. 1, distributed at longer intervals along the lane. The detection points are equipped with axle detectors 25 and 25', vehicle detectors 26 and 26' in the form of induction loops, drive-over scales 27 and 27', and dynamic wheel-load sensors 28 and 28'. The traffic-sensor system can also be equipped with unillustrated environmental-pollution sensors.

The road-and-traffic sensing systems in adjacent detection points 24 and 24' along both lanes 21 and 21' are provided with a processing unit in the form of a road-event processor 30 for processing the speeds, vehicle types and weights, and axle loads detected by the sensors at each detection point and for local and optionally paired and higher-level traffic-disruption calculations with automatic algorithms. Operating in conjunction with road-event processor 30 is a signal processor 32 associated with the detection point. Operating in conjunction with it by way of a network 33 are intelligent luminescent elements 34 and 34' with signal lamps 35 and 35' distributed at intervals on each side along the edge of the lane. Signal lamps 35 and 35' are statically or dynamically interconnected into chains of lamps or into a lighting bus 36 and 36'.

As will be evident from FIG. 1, several detection points are distributed at intervals along the direction of travel with associated processors and controls and hence interconnected chains of lamps. The road-event processors 30 associated with the detection points 24 and 24' distributed along the lane are interconnected by way of a communications network 38. The chains of lamps subordinated to each particular signal processor 32 are interconnected into a lighting bus 36 and 36'. Each luminescent element 34 has a manually operated emergency switch 40 and 40' that allows manual activation of the chains of lamps in the event of an accident or other emergency along an interval opposite the direction of traffic that depends on the shape of the road.

When the traffic-sensing system at a detection point 24 and 24' detects a disruption in traffic like various drivers traveling at very different speeds, the situation will be detected by the associated road-event processor 30 and automatically acknowledged by prescribed traffic-disruption algorithms. This leads by way of the signal processor 32 operating in conjunction with the road-event processor for example to activation of the chain of lamps such that their signal lamps 35 and 35' begin to operate with flashes of light traveling in the same direction as the traffic and at the desired speed along the lane, motivating the drivers to drive at the same speed. When a vehicle travels at excess speed over the road-and-traffic sensing system at a detection point, the chains of lamps will operate such that the blinking mode of individual signal lamps in the chain will be visible ahead of the vehicle at the same speed of travel until the driver decelerates to an acceptable speed.

Figure 3:
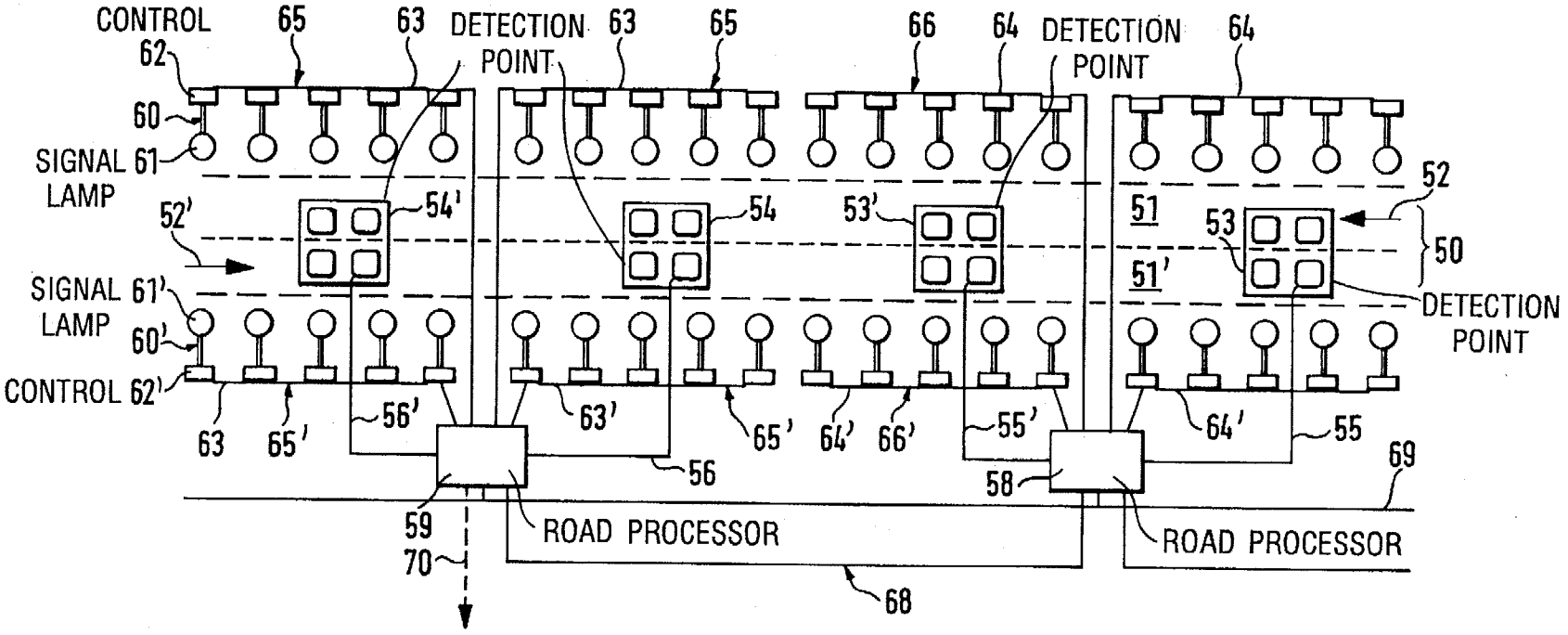
FIG. 3 is a schematic representation of an alternative system that incorporates road-event processors, each associated with a specific stretch-of-road section and all intercommunicating through a special network.

The road 50 in the system schematically illustrated in FIG. 3 consists of two adjacent lanes 51 and 51' for traffic traveling in opposite directions. The road is equipped with a monitoring and information-provision system consisting of two subordinate systems. Each subordinate system comprises a road-event processor. The directions of travel are indicated by arrows 52 and 52'. Each subordinate system has two detection points 53 & 53' and 54 & 54' distributed at intervals along the road. The detection-point sensors are connected to their associated road-event processors 58 and 59 by way of networks 55 & 55' and 56 & 56'. Also distributed at intervals along each side of the road are luminescent elements 60 and 60 ' with signal lamps 61 and 61' and electronic controls 62 and 62' interconnected by way of a network 63 & 63' and 64 & 64' into chains of lamps 65 & 65' and 66 & 66' respectively and each connected to its associated road processor 58 or 59. The road processors associated with the sequence of subordinate systems distributed along the road, finally, are interconnected by way of a processor network 68 and to an only schematically indicated source 69 of power. Each road processor can also be provided with a modem interface 70 and connected to a control center if necessary.

The alternative illustrated in FIG. 3 differs from the system specified hereintofore in conjunction with FIG. 2 in that road processors 58 and 59 are provided with slots for various functions and do not require separate signal processors.

Figure 4:
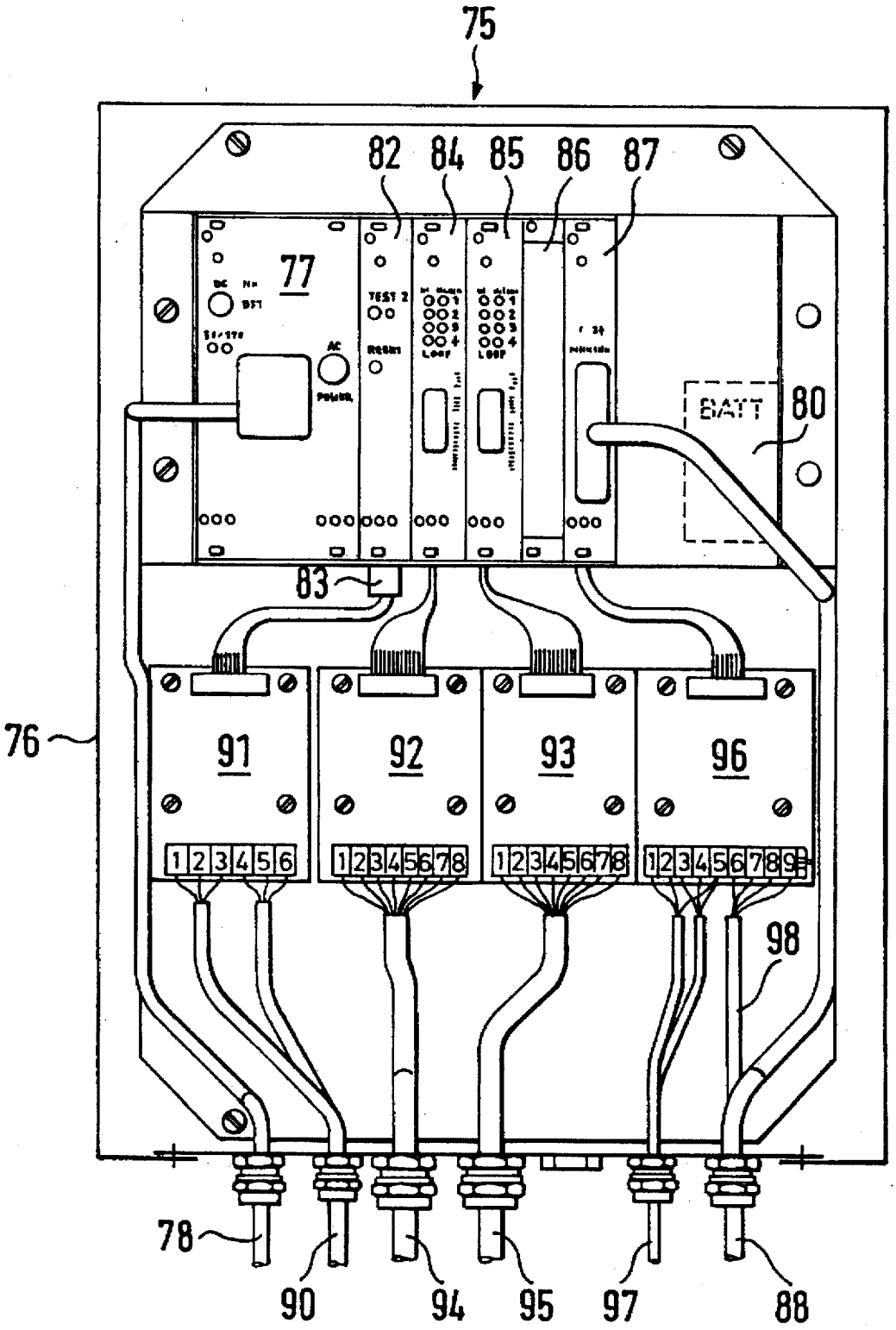
FIG. 4 illustrates the structure of a road-event processor for processing detected traffic situations and/or road conditions and or operating system-internal signal generators and/or other traffic signs.

The road processor 75 illustrated in FIG. 4 is a piece of equipment with its various components accommodated in a housing 76 that is sealed off from the environment. Five slots are positioned between a power supply 77 connected to a cable 78 that extends out of the system and a backup battery 80. The slots accommodate the various processor cards.

Directly adjacent to power supply 77 is a central processor 82 with a lap-top interface 83. Adjacent to it are two induction-loop processor cards 84 and 85. Adjacent to them is an insert 86 for neuronal processing. Between the insert and battery 80 is an insert 87 in the form of an interface-card data network. It is directly connected to a data-interface modem 88 that extends out of housing 76.

The various inserts are connected by way of connector subassemblies in the form of modular boards. The boards are provided with strip terminals that mediate between the direct connection to the processor network, the sensor system, and a data interface for the signal network. Processor network 90 extends through an appropriate cable extension through the outer housing and is routed to the connector board that mediates the connection to the central processor. The illustrated embodiment has two processor cards for induction loops, each connected to a connection board 92 and 93. Connection to the associated sensor system is provided by lines 94 and 95 extending through bushings through the housing to the board's terminal strips. Signal lines 97 and 98 that activate the luminescent elements are connected to the remaining connection board 96, which communicates with the interface-card data network. The connector subassemblies are also equipped with integrated lightning resistors.

Figure 5:
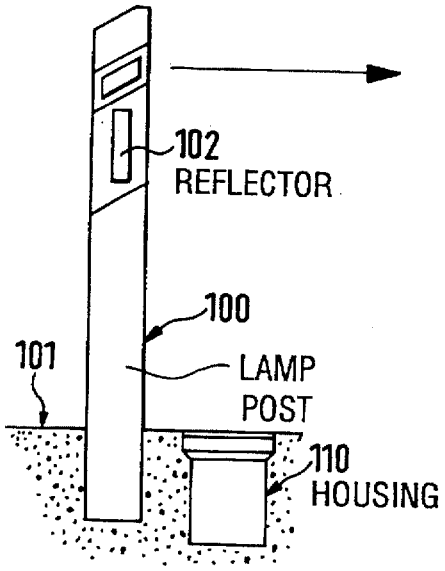
FIG. 5 illustrates route guideposts in the form of lampposts with signal lamps and with an in-the-ground housing accommodating the electronic controls.

The luminescent element illustrate in FIG. 5 is a road guidepost in the form of a lamppost 100. The lamppost has the typical cross-section in the form of an equilateral triangle. Its bottom is anchored in the ground 101 at the edge of the road. The apex of the triangular cross-section is toward the road, and the side facing the oncoming traffic is provided with a vertical rectangular reflector 102.

Figure 6:
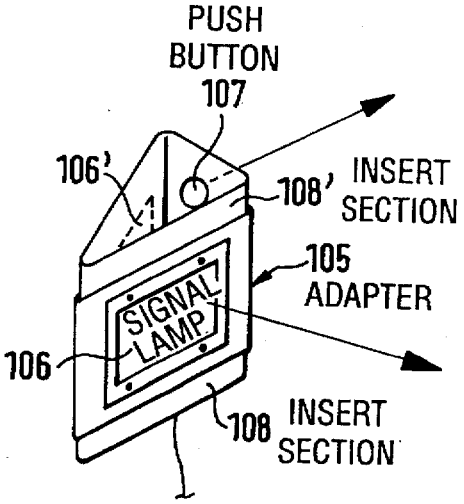
FIG. 6 illustrates a guidepost adapter with one signal lamp aimed forward and one signal lamp aimed backward.
Figure 7:
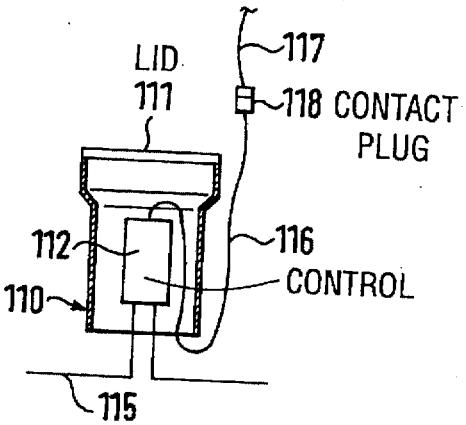
FIG. 7 illustrates an in-the-ground housing with electronic controls for a luminescent element.
Figure 8:
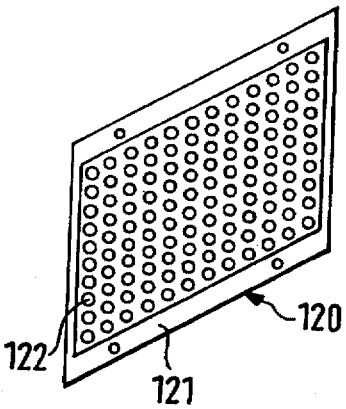
FIG. 8 is a signal-lamp luminous field element in the form of an LED array in itself.
Figure 9:
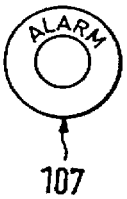
FIG. 9 is a pushbutton for activating signal lamps to emit alarm signals over a bus system.

A conventional guidepost can be converted to a lamppost 100 with an adapter 105 in the form of a module that fits over reflector 102 and has as illustrated in FIG. 6 signal lamps 106 and 106', one of them facing the ongoing traffic and the other the departing traffic, as well as a manually operated pushbutton 107. The guidepost adapter has an upper insert section 108 and a lower insert section 108'. The cross-section of the insert section matches the inner cross-section of the guidepost. The modular adapter 105 for lamppost 100 is accommodated between the section of the guidepost with vertical reflector 102 and a cap over the top of the guidepost. Signal lamps 106 and 106' are positioned in the sides of adapter 105 that converge toward the road. The manually operated pushbutton 107 is in the side facing away from the road.

Immediately adjacent to lamppost 100 and in ground 101 is housing 110 with a removable lid 111. The housing accommodates the electronic controls 112 associated with the luminescent element. The electronic controls communicate by way of a cable network 115 with the luminescent elements adjacent to them. They are connected to the signal lamps 106 and 106' in guidepost adapter 105 and to pushbutton 107 by way of lines 116 and 117 and a contact plug 118. Plug 118 is a dismantle-or-demolish plug that facilitates removing the guidepost adapter along with the signal lamps and pushbutton.

The lamppost signal lamps accommodated in guidepost adapter 105 are equipped with luminous field elements 120 in the form of LED arrays. The LED's themselves are secured in a plastic frame 121 mounted in order to simplify the connection procedure on an unillustrated metal plate. They are encapsulated in the frame at the bottom. Encapsulating the LED's only at the bottom ensures that their brightness cannot be deteriorated by dirt when employed outside because the LED domes are subjected to natural cleaning and the light flux is fixed to the domes.

Figure 10:
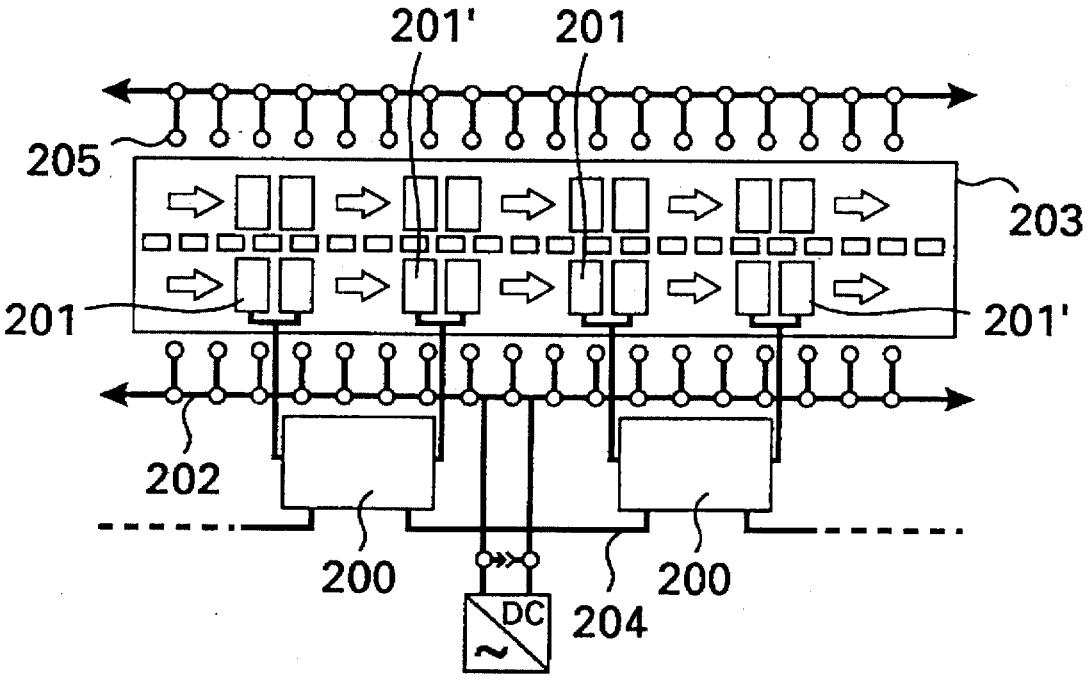
FIG. 10 is a simplification of FIG. 3.

The FIG. 10 is a simplification of FIG. 3 to illustrate the system's decentralized and transparent structure. Associated with each processor 200 are at least two sensors 201 and 201' that monitor a section of road. A network 202 of signal lights extends along road 203. Processors 200 themselves comprise a processor network 204. Signal-light network 202 and processor network 204 are coupled, with each processor 200 controlling several, five for example, signal lights 205.

Figure 11:
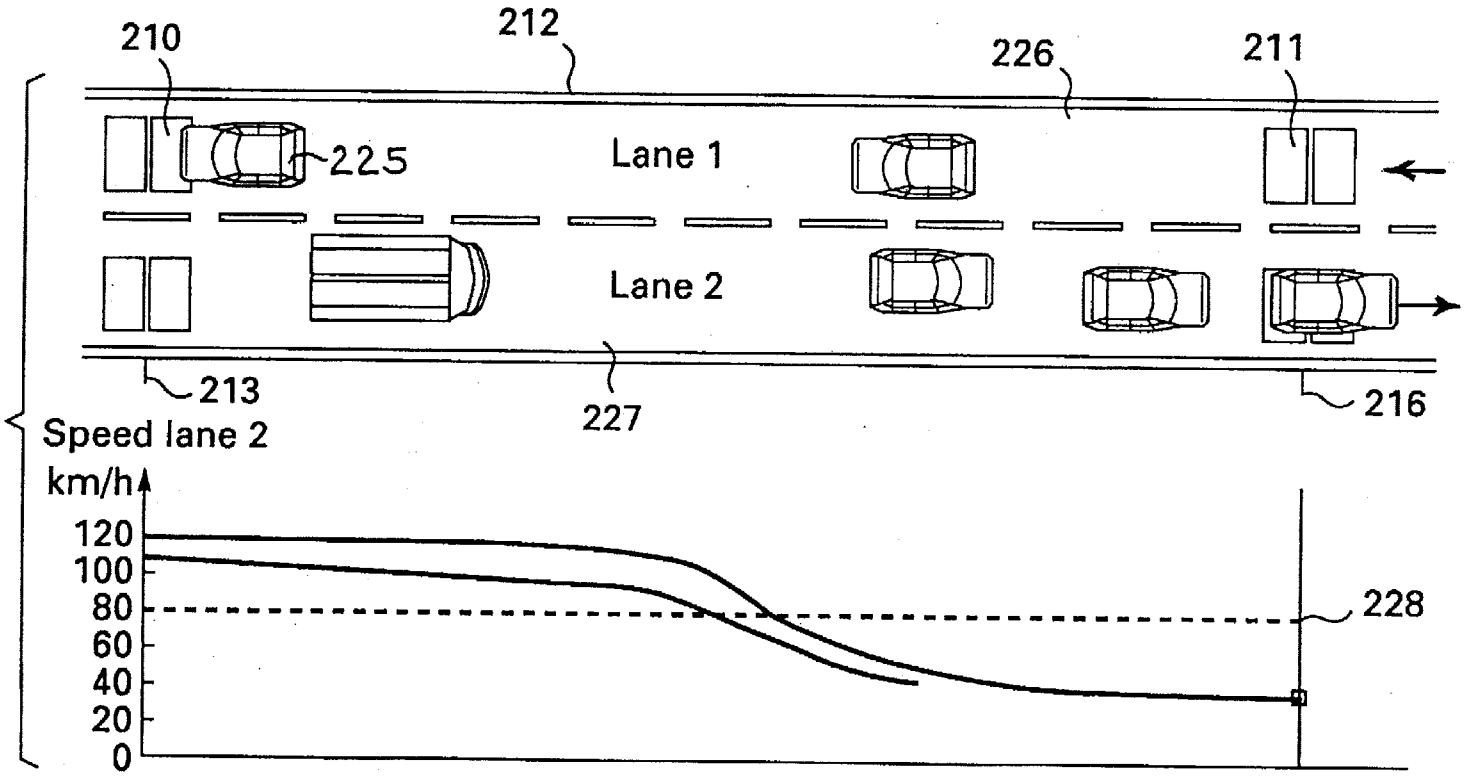
FIG. 11 is a speed over distance graph and a monitored road section.

One example of how an alarm can be triggered is illustrated in FIG. 11. FIG. 11 illustrates another road section 212 that extends between two detectors 210 and 211. The detectors determine the number of vehicles 225 per lane 226 and 227 per section as well as the distance between individual vehicles 225. A reference speed 228 for the road-section 212 under surveillance is constructed from these data. An alarm 1 is triggered as soon as a prescribed number of vehicles 225 are driving below reference speed 228. Only automobiles are monitoring in relation to alarm 1. A separate alarm 2 is employed for trucks. Associated with each alarm is a special mode of operating the signal lights. This is represented by the following alarm matrix, which can for example be programmed in the form of polling loops in the processors in question.

Alarm-Matrix

| Alarm | | No of activated light posts | Activated area | Display made | Display | Brightness |
|---|---|---|---|---|---|---|
| (1) | Speed threshold min. for passenger cars | 5 | behind | Counterwave | medium | bright |
| (2) | Speed threshold min. for trucks | 5 | behind | Counterwave | medium | bright |
| (3) | Negative speed modification | 5 | behind | Counterwave | medium | bright |
| (4) | Occupancy of lane | 5 | behind | Counterwave | medium | bright |
| . | | | | | | |
| . | | | | | | |
| . | | | | | | |
| (11) | Speed violation of passenger cars | 4 | in front | blinking | fast | dark/bright |
| (12) | Speed violation truck | 4 | in front | blinking | fast | dark/bright |
| (13) | No passing-passenger car | 5 | in front | blinking | fast | bright |
| (14) | No passing-passenger trucks | 5 | in front | blinking | fast | bright |
| (15) | Wrong direction driver detection | 5 | in front | blinking | fast | dark/bright |
| . | | | | | | |
| . | | | | | | |
| . | | | | | | |
| (21) | Modification of the average speed between two measurement points | 5 | behind | Counterwave | medium | bright |

-continued

Alarm-Matrix

| Alarm | | No of activated light posts | Activated area | Display made | Display | Brightness |
|---|---|---|---|---|---|---|
| (22) | Modification of the n-vehicles of 2 measurement points | 5 | behind | Counterwave | medium | bright |
| . | | | | | | |
| . | | | | | | |
| . | | | | | | |
| (30) | Manual alarm release | 5 | behind | blinking | fast | bright |

Figure 13:
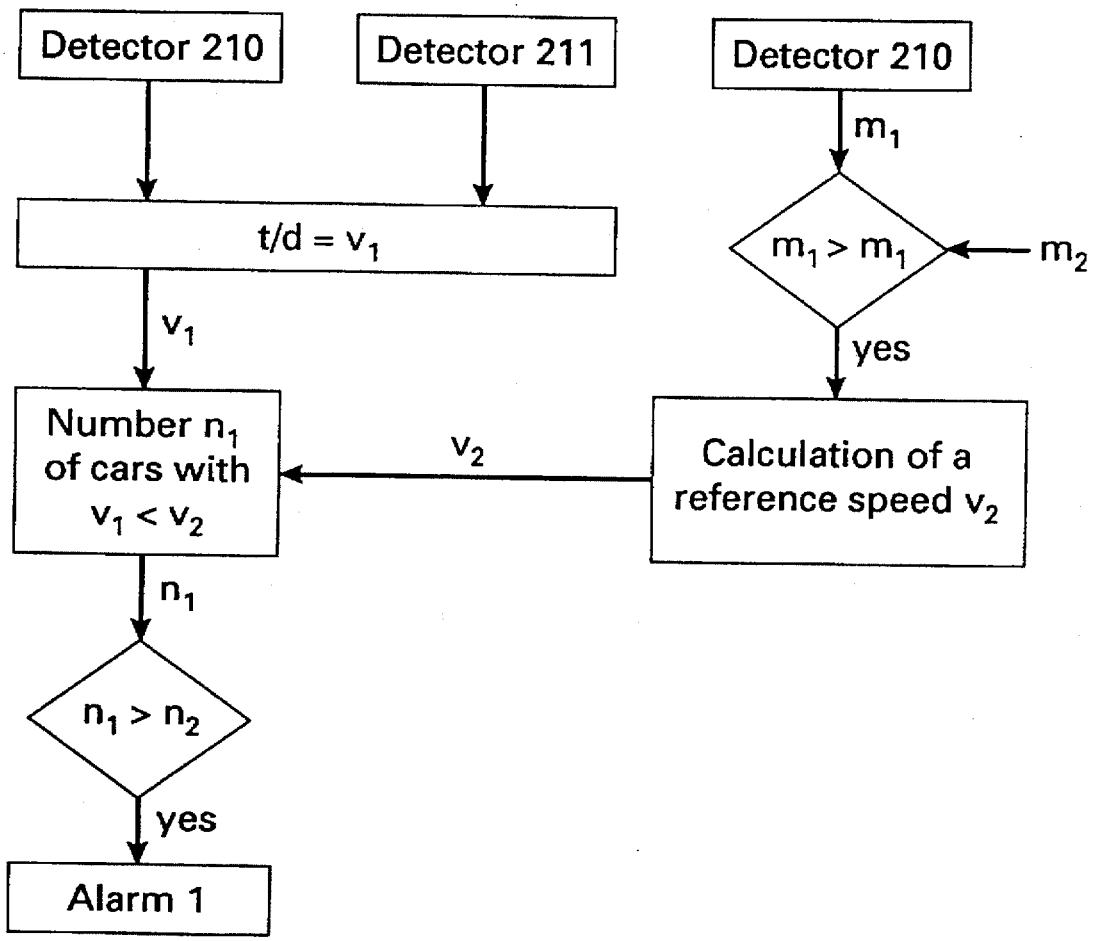
FIG. 13 is a flowchart of an example of a controlling algorithm.

Accordingly to the example of a algorithm to control the holding of a minimum reference speed 228 into the range of a monitored road-section between two detectors 210 and 211 is for a better understanding the flowchart in FIG. 13.

The given flowchart could be extended by the input and calculation of signals from neighboured road-sections or the realization of other features like the distinguished surveillance of a minimum reference speed for trucks. Relating to the system of distributed intelligence the alarm signal or the calculated parameters can first be given to a higher step of evaluation before giving said alarm. In this way it is possible to monitor longer distances of roads and to take care for possible more important given parameters or traffic control concepts.

Figure 12:
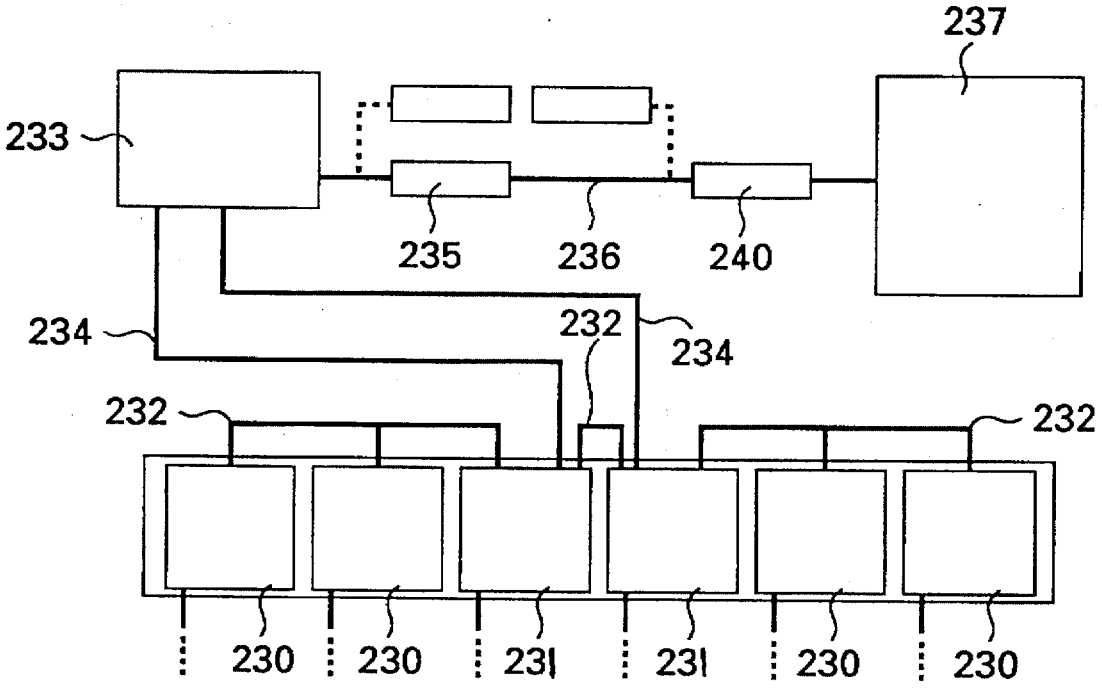
FIG. 12 is a block-diagram of meshed networks for monitoring traffic and of providing information and warnings to drivers of the actual traffic-conditions.

In the embodiment of the invention illustrated in FIG. 12, six road-even processors 230 and 231 are combined into a network 232 immediately adjacent to the road. Each processor 230 is a master and each processor 231 a slave. Master processors 231 are connected to a decentralized communications computer 233, through which processors 230 and 231 can be directly programmed and parametered on site. All detected results are transmitted to communications computer 233 at 30-second intervals by way of an RS-233 interface 234 at a rate of either 9700 or 19 200 baud. The communications computer is programmed in C language. It communicates through a modem 235 and the public telephone network 236 with a central control station 237, which has a modem 240.

We claim:

1. A traffic-monitoring and information-providing system for monitoring and analyzing vehicular traffic and providing information and warnings to drivers on traffic disruptions, driver errors, dangerous road conditions, and severe weather conditions, comprising: sensing means enclosing detection points with induction loops; drive over scales and dynamic wheel-load-sensors; a specific number of road-event-processors connected to said dynamic wheel-load sensors; an intelligent bussystem interconnected to said road-event processors; a varying processor network of distributed intelligence interconnected to said road-event processors through said intelligent bus system; signal processors connected to said varying processor network; a signal network for generating traffic signals; a lighting bus for connecting said signal processors to said signal network; a plurality of interconnected luminescent elements receiving traffic signals from said signal network; said luminescent elements having signal lamps as optical signal generators.

2. System as defined in claim 1, wherein the traffic and load sensing equipment comprises speed sensors, axle detectors, induction loops, drive-over scales, and wheel-load meters.

3. System as defined in claim 1, including at least two detection points distributed at prescribed intervals along a road with traffic and load sensing equipment, interconnected signal lamps, and at least one processor-and-control set in the form of a road-event processor.

4. System as defined in claim 1, wherein the luminescent elements with signal lamps are distributed along and on both sides of the road.

5. System as defined in claim 1, wherein the luminescent elements with signal lamps are combined into chains in form of a bus and can be activated in groups as well as individually.

6. System as defined in claim 1, wherein the road-event processors in several detection points communicate through a network.

7. System as defined in claim 1, wherein the luminescent elements can be programmed and controlled in accordance with traffic situations and road conditions detected by roadside traffic and load sensing equipment in the detection points.

8. System as defined in claim 7, wherein the luminescent elements are modules for installation in existing roadside lamp posts.

9. System as defined in claim 7, wherein the signal lamps are equipped with monochromatic luminous field elements selectively in various colors and in form of luminous field elements operable on the basis of blended hues, said luminous field elements being power-optimal LED arrays.

10. System as defined in claim 8, wherein the luminescent-element signal lamps in said luminescent elements are activated by intelligent electronic controls having a computer module with a bus interface and are provided with an address allowing programmed activation of a luminescent element.

11. System as defined in claim 10, wherein the signal lamps in the luminescent elements are routed to their respective intelligent electronic control through plugs.

12. System as defined in claim 8, wherein the luminescent elements are equipped with sensors communicating with a road-event processor through a system-inherent computer network and detecting the direction of traffic.

13. System as defined in claim 1, wherein the roadside sensing system of detection points that detect traffic situations and road conditions communicates through a network with a road-event processor serving as an overall processor activating the signal lamps individually, all together, as well as in a specified sequence and coordinates interface cards for various sensors as well as signal-processing units.

14. System as defined in claim 13, wherein a series of detection points is distributed along a road, each with a system of sensors communicating with a road-event processor through a network to detect traffic situations and road conditions, the road-event processors associated with each stretch section communicating through a network.

15. System as defined in claim 13, wherein the road-event processor and the sensing devices connected thereto are means for remote trouble shooting and are remotely diagnosable to be watched by a central station.

16. System as defined in claim 15, wherein parameters and thresholds can be remotely entered and tested electronically from the central station.

17. System as defined in claim 13, wherein the road-event processor processes detected vehicle data and generates resulting data during data processing and compares them with variable thresholds, said road-event processor having a transgression matrix containing configurable thresholds for comparing single parameters and selecting combinations of parameters.

18. System as defined in claim 13, wherein the road-event processor classifies traffic disruptions and dangerous traffic situations.

19. System as defined in claim 13, wherein the road-event processor operates conventional traffic-disruption algorithms.

20. System as defined in claim 13, wherein the road-event processor processes detected traffic situations and road conditions in neural architectures, an error-tolerant and wide-ranging associative matrix allowing real-time processing on site coding threshold transgressions and classifying traffic situations, a trained hetero-associative network classifying traffic situations and interruptions in real time, said network being a neuronal network using images of traffic dimensions and thresholds summarized in a learning file along with practical empirical measurements and synthetically generated training patterns and signal patterns modified with variances for training purposes, classifying traffic situations and disruptions in real time in an ABLE phase.

21. System as defined in claim 20, wherein the road-event processor classifies vehicle models in neuronal architectures, classes of vehicles being represented by signal patterns from individual sensors as induction-loop dissonances, and by combinations of signal pattern from several sensors.

22. System as defined in claim 13, wherein every road-event processor has at least one interface for attaching environmental sensors and for processing and optionally storing environment data and, in event of infringement of prescribed thresholds, for releasing alarms and actual-state displays.

23. System as defined in claim 13, and operating automatically with on-site violation detection and automatic alarms.

24. System as defined in claim 13, wherein vehicle weight and axle load selectively detect traffic disruptions along with such other criteria as number of vehicles, model, and speed for the estimation of traffic-engineering parameters and disruptions.

25. System as defined in claim 13, wherein the processor-network has a modular structure and comprises road-event processors signal processors, and interface inserts along with a master processor coordinating at least one module of said processor network, said road-event processor having slots for potential expansion and for interchanging sensors and sensor-system interfaces, all said processors and slots being replaceable and communicating through a bus, a sensor coupling being simultaneously serviceable by modular connector boards, a respective connector board for each type of sensor and interface being attachable and having integrated anti-lightning protection.

26. System as defined in claim 13, wherein the road-event processor has an interface module allowing operation through a real-time computer network and with synchronization allowing operation with parallel networks and a combination of sensing devices and actuating mechanisms, which are working under real time conditions.

27. A method for monitoring vehicular traffic and providing information and early warnings to drivers on traffic disruptions, driver error, dangerous road conditions, and severe weather conditions, comprising the steps of: detecting road and traffic conditions with a net of sensing equipment enclosing detection points with induction loops, drive over scales and dynamic wheel load sensors; emitting traffic information signals by a measurement network to a given number of road event processors interconnected with an intelligent bussystem to a varying processor network with distributed intelligence means interconnected with signal processors combined to a signal network by a lighting bus; and displaying said traffic conditions over interconnected luminescent elements with signal lamps distributed at intervals along the road and combined into chains of lamps illuminated for providing continuously said traffic information signals emitted from the measurement network at a communication network to said interconnected luminescent elements.

28. Method as defined in claim 27, wherein said signal lamps in said luminescent elements are operated at variable pulse lengths, variable frequencies, and variable pulse-activation ratios.

29. Method as defined in claim 27, wherein said luminescent elements are at least partly activated and operated against the flow of traffic at one time by roadside sensors communicating with the processor-network.

30. A method as defined in claim 27, wherein to obtain real-time behavior and cover continuous sections of road, said luminescent elements are activated by at least one detection point signal to the processor network and interpretation of said detection point signal by the processor network following a given alarm-matrix for having an automatic malfunction recognition or by manual illumination on interpretation of traffic data from at least two sensors and processors and comparison thereof, or by interpretation of the sensor system by procedures carried out in control centers.

31. Method as defined in claim 27, wherein states of illumination of the signal lamps in the luminescent elements are monitored and controlled by central controls.

32. Method as defined in claim 27, wherein violations as excess speed, truck passing, overload, driving in the wrong direction, etc. are detected, and the signal lamps blink to inform the driver of what violations are detected.

33. Method as defined in claim 32, wherein said chains of lamps operate in real time in conjunction with the sensing equipment, using various malfunction-detection algorithms.

* * * * *